US005339971A

United States Patent [19]

Röhrig

[11] Patent Number: 5,339,971

[45] Date of Patent: Aug. 23, 1994

[54] FEEDING BOTTLE

[75] Inventor: Peter Röhrig, Vienna, Austria

[73] Assignee: Mam Babyartikel Gesellschaft M.b.H., Vienna, Austria

[21] Appl. No.: 923,887

[22] PCT Filed: Jan. 31, 1991

[86] PCT No.: PCT/AT91/00016

§ 371 Date: Oct. 20, 1992

§ 102(e) Date: Oct. 20, 1992

[87] PCT Pub. No.: WO91/12791

PCT Pub. Date: Sep. 5, 1991

[30] Foreign Application Priority Data

Feb. 22, 1990 [AT] Austria ..... 422/90

[51] Int. Cl.[5] ..... A61J 9/04

[52] U.S. Cl. ..... 215/11.5; 220/373

[58] Field of Search ..... 215/11.5, 261; 220/373, 220/89.1, DIG. 27; 222/87.5

[56] References Cited

U.S. PATENT DOCUMENTS 2,959,314 11/1960 Sanchez .
3,292,808 12/1966 Greene ..... 215/11.5
3,650,270 3/1972 Frazier .
3,768,682 10/1973 Meyers et al. ..... 215/11.5
4,093,105 6/1978 Russell et al. ..... 220/373
4,648,519 3/1987 Kennedy ..... 215/261
4,685,577 8/1987 Chen .
4,821,896 4/1989 Cheng ..... 215/11.5 X
4,828,126 5/1989 Vincinguerra ..... 215/11.5
4,865,207 9/1989 Joyner et al. ..... 215/11.5

FOREIGN PATENT DOCUMENTS 0009460 4/1980 European Pat. Off. ..... A61J 9/04

*Primary Examiner*—Allan N. Shoap
*Assistant Examiner*—Chris McDonald
*Attorney, Agent, or Firm*—Ladas & Parry

[57] ABSTRACT

There is disclosed a feeding bottle comprising a bottle body (1) provided with micropore air inlet opening means in its bottom region (2), which enable the inflow of ambient air, yet impede the leakage of a liquid bottle content, and which is formed by micropores (5) provided directly in the bottle body (1) in its bottom (2), which is designed in one piece with the remaining bottle body (1).

6 Claims, 1 Drawing Sheet

FEEDING BOTTLE

FIELD OF THE INVENTION

The invention relates to a feeding bottle comprising a bottle body provided with micropore air inlet opening means in its bottom region, which enable the inflow of ambient air, yet impede the leakage of a liquid bottle content.

UNDERLYING PRIOR ART

Feeding bottles of this type serve to administer liquid food, such as tea or pap, to babies and infants, and, for this purpose, they comprise a nipple in their ready-for-use state, which is clamped to the bottle neck, for instance, by means of a screw cap. When using such feeding bottles, the problem arises that a negative pressure forms within the bottle during sucking of the content through the nipple, which frequently impairs the drinking procedure to a major extent. For pressure compensation, the continuous entry of air into the bottle interior must, therefore, be ensured, which, as a rule, is effected by interrupting the drinking procedure such that air can get into the bottle interior through the nipple. It goes without saying that the intake of food is thereby disturbed. Consequently, solutions have already been suggested (cf. e.g. U.S. Pat. Nos. 3,650,270, 2,959,314, FR-A-2,446,632), according to which air is to be fed to the bottle interior in the region of the nipple or bottle neck, for instance, via baffles or via sort of flap valves. However, such configurations are rather complex and, moreover, involve cleansing problems. Furthermore, it is disadvantageous that the compensation air is supplied in the immediate vicinity of the nipple, which may result in air being swallowed during drinking, which is disadvantageous. Other solutions to this problem (cf., e.g., EP-A-9 460 or CH-A-439 585) aimed at providing a readily sliding piston or a bag in the feeding bottle to separate the liquid volume from an air volume, which, in turn, communicates with the atmosphere such that compensation air can pass into it. However, the insertion of such a more or less complex structural part also is disadvantageous, rendering handling and perfect cleaning difficult. The aforementioned disadvantages also apply to the feeding bottle according to U.S. Pat. No. 4,685,577, on whose bottom a screw plug including a screw cap is provided, by which a bottom plate is mounted, which closes the otherwise open bottle bottom and includes several one-way spear valves enabling the entry of compensation air.

Finally, a feeding bottle of the initially described type is known from U.S. Pat. No. 4,865,207, in which also a screw cap is fastened to the lower end of the feeding bottle in order to fix a membrane provided with micropores as a bottom plate to the lower, open bottle body by this screw cap. This microporous membrane in respect of its pores is designed so as to prevent the leakage of liquid, yet to allow for the entry of air. The membrane, in particular, is enclosed between two grid plates that constitute supporting elements, and the thus formed air inlet device, hence is relatively complex and expensive, involving the disadvantage of difficult cleaning. Moreover, the threaded configuration including the screw cap implies an important additional structural expenditure such that a feeding bottle of this type hardly can be produced in an economic manner.

SUMMARY OF THE INVENTION

It is the object of the invention to provide a feeding bottle of the initially described type, which allows for pressure compensation during drinking as indicated, without requiring additional components, thus being simple in terms of manufacture and use.

In accordance with the invention, the feeding bottle of the initially described type is characterized in that the micropores are provided directly in the bottle body, in the region of its bottom, and the bottom is designed in one piece with the remaining bottle body. With such feeding bottles, the disadvantages of the known solutions are avoided, and the intake of air for pressure compensation is ensured through the micropores in the bottom region in a constructionally simple manner while retaining a uniform stable bottle body comprising a bottom; the form and size and number of these micropores are such that leakage of the liquid bottle content through the same is prevented, yet pressure compensation is feasible to the necessary extent.

The invention utilizes the possibilities of modern laser technology, by which various materials, such as, e.g., polycarbonate, of which the feeding bottle body is made, for instance, can be pierced with holes whose dimensions are so small that they prevent the passage of liquid molecules, such as water molecules, yet allow for the passage of air molecules.

Accordingly, the invention also relates to a method of producing a feeding bottle as defined above, which method, according to the invention, is characterized in that, after production of the bottle body of synthetic material, for instance, in a blowing process, the micropores are burnt in in the bottom region by aid of a laser beam. Preferably, a sufficiently energy-rich laser, in particular, a $CO_2$-laser, is used for burning in the micropores.

Basically, micropores may be provided in the bottle body both in the bottom and in its side wall adjacent the bottom in a manner that the pressure compensating air may enter the bottle interior during use of the feeding bottle, i.e., during drinking, on the bottle end remote from the nipple. However, it has proved that it is to be preferred to provide the micropores only in the bottom of the bottle body both in view of the pressure compensation sought and in view of the manufacture of the feeding bottle.

Finally, it is of a particular advantage if the micropores are solely provided in an inwardly curved central zone of the bottom of the bottle body. Such a bottom configuration on the one hand provides for a Greater overall stability of the bottle bottom due to the inwardly directed curvature so as to prevent any deformation of the bottle body in the bottom region affecting the cross sectional shape and, thus, the function of the micropores, and on the other hand the micropores also are well protected against contamination, being at a distance from the support with the bottle deposited.

BRIEF DESCRIPTION OF THE DRAWINGS

The invention will be explained in more detail by way of a preferred exemplary embodiment illustrated in the drawings, to which it is, however, not limited. In the drawings.

DETAILED DESCRIPTION OF THE PREFERRED EMBODIMENT

Figure 1:
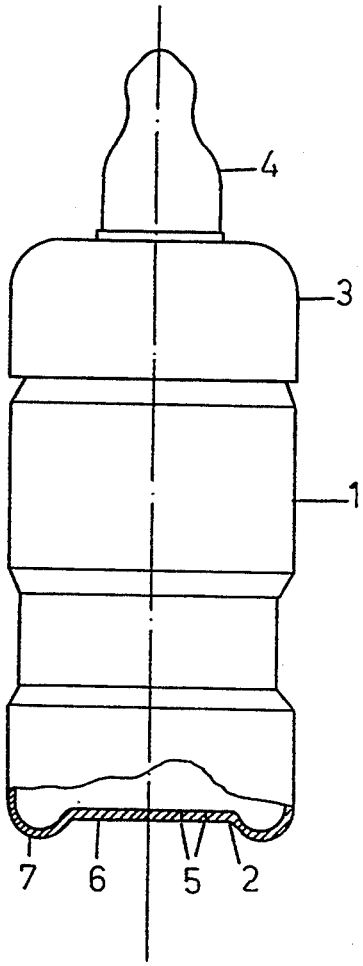
FIG. 1 is a partially broken-away view of a feeding bottle having an integrally formed bottom.

The feeding bottle represented in FIG. 1 in its complete outfit, in a conventional manner, comprises a bottle body 1, which is downwardly closed by an integrally formed bottom 2. This bottle body 1, for instance, can be made of a synthetic material, such as polycarbonate, by a conventional blowing process.

To the open upper side of the bottle body 1, which is not visible in the drawing, a screw cap 3 is screwed in the manner of a clamping nut, by which a nipple 4 can be fastened to the bottle body 1.

With respect to the general configuration of such a feeding bottle, it is also referred to, for instance, EP-A-311 596, wherein it should be added that any other bottle shapes, in particular so-called "narrow-necked" feeding bottles, are, of course, feasible.

In order to enable the intake of air into the bottle interior during drinking with such a feeding bottle, the bottom 2 of the bottle body 1 is provided with micropores 5 in the form of very fine bores, which, for instance, are provided in an inwardly curved central zone 6 of the bottom 2 of the bottle body 1 to follow a pattern of concentric circles or of radial beams. Due to this inward curvature of the central zone 6, an external downwardly projecting edge region 7 of the bottom 2, moreover, is obtained, which serves as a foot for the feeding bottle to stand thereon.

Figure 2:
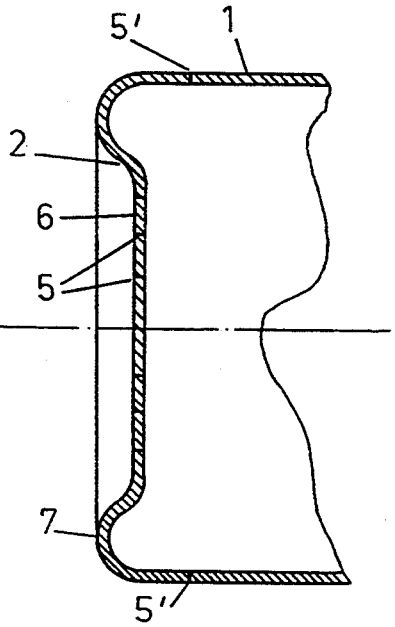
FIG. 2 is an axial section of the bottom region of the bottle body of the feeding bottle according to FIG. 1 on an enlarged scale.

The diameter of the micropores 5 is so small that water and other liquid food cannot penetrate through the micropores 5 on account of the surface tension, i.e., that not even any capillary action will take effect, but air can enter the bottle interior under the negative pressure forming while sucking out the bottle content. It should also be appreciated that the pore size be such that the pores will not be obstructed by the bottle content. Besides, it is important that the entry of air for pressure compensation occurs in the region of the bottle bottom 2, i.e., in the bottom 2 itself and/or in the neighboring sidewall region, as is indicated in FIG. 2 at 5', i.e., the entry of air takes place as remote from the nipple 4 as possible in order to prevent the infant from swallowing inflow air during drinking.

Figure 3:
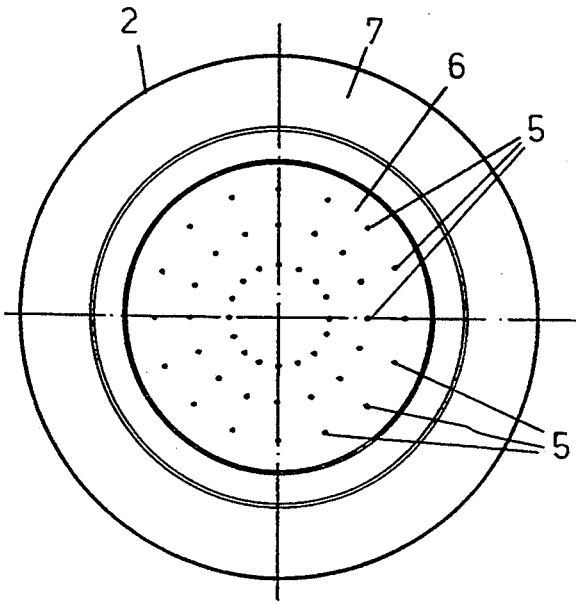
FIG. 3 is a pertaining view of the bottom of this feeding bottle from below.

The number of micropores 5 and 5' is selected to enable an appropriate pressure compensation by the air intake in case of a negative pressure as it is brought about by infants during drinking, i.e., as much volume of air is to be allowed to enter the bottle per time unit as the baby can suck per time unit. The overall cross sectional area of the micropores 5 and 5' and, thus, the number of micropores are assessed accordingly. In this context, it should be noted that the arrangement of the micropores 5 is completely schematical in the illustration according to FIG. 3 and that, as a rule, substantially more micropores 5 than those illustrated have to be provided in order to ensure sufficient air intake.

The size of the micropores 5 and 5' may be determined as a function of the bottle material used as well as of the liquid food the bottle is destined for (either thick, pappy food or tea, etc.). For instance, the micropores 5 and 5' may have round cross sections having diameters of from some μm to about 50 μm or more, at a bottom thickness of from 1 to 1.5 mm (bottle body of polycarbonate).

Figure 4:
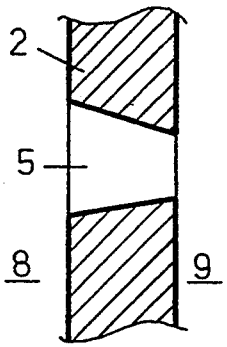
FIG. 4 illustrates a detailed section through the wall of the bottle body in the region of a micropore strongly enlarged and not to scale.

The form of the micropores 5 may be similar to a cylindrical to conical bore. In FIG. 4, a micropore 5 is represented, which is conical in its longitudinal or axial section and has a larger diameter on the external side 8 of the bottle e.g. ranging between 50 μm and 100 μm than on the internal side 9, on which the diameter may, for instance, amount to approximately 5 μm.

In practical experiments, satisfactory results were obtained with feeding bottles whose bottle bodies 1 were made of polycarbonate having a wall thickness of about 1 mm and in the body region of which approximately 150 to 200 micropores having the conical form of FIG. 4 and internal-side diameters of from 3 μm to 7 μm and external-side diameters of from 50 μm to 100 μm had been burnt. However, it has been proved that it also may be satisfactory to provide the micropores (5' in FIG. 2) in the side wall of the bottle body 1 only, approximately at a height of 1 cm to 2 cm above the bottom 2 or its foot 7, although the provision of the micropores 5 in the bottom 2 itself is to be preferred.

To produce the micropores 5 in the bottom 2 or its central zone 6, a sharply focussed beam of a high-performance laser, in particular, of a $CO_2$-laser, is used, by which the material of the bottle body 1 previously produced, e.g., in a blowing process, is melted and evaporated on the site of the micropores to be formed or burnt in. It is, for instance, possible to use a laser having a power of some 100 mJ or some J, wherein, if desired, even several micropores 5 or 5' can be burnt in simultaneously (e.g., by aid of a beam splitter arranged in the beam path).

I claim:

1. A feeding bottle for administering liquids to babies and infants, said feeding bottle comprising a bottle body formed in one piece and having a generally cylindrical side wall and a bottom wall integral with the side wall of the bottle body, a nipple fastened to the bottle top, and a plurality of micropores provided in a region of the body near and in said bottom wall, said micropores each having a substantially tapered conical configuration, with the largest diameter between about 50 μm to 100 μm formed in the external side of the bottle wall and the smallest diameter of between about 3 μm to 7 μm formed in the internal side of the bottle wall to facilitate an inflow of ambient air while impeding leakage of the liquid contents from the bottle.

2. A feeding bottle according to claim 1, wherein the micropores are centrally provided in the region of said bottom only.

3. A feeding bottle according to claim 1, wherein the micropores are provided in an inwardly curved central zone of the bottom.

4. A feeding bottle according to claim 1, wherein the micropores are burnt in the region of the bottom by means of a laser beam after production of the bottle body of synthetic material.

5. A feeding bottle according to claim 4, wherein the laser beam for burning the micropores is a $CO_2$-laser.

6. A feeding bottle according to claim 4, wherein the bottle body is produced in a blowing process.

* * * * *